US009827469B1

(12) United States Patent
Seluga et al.

(10) Patent No.: US 9,827,469 B1
(45) **Date of Patent: *Nov. 28, 2017**

(54) IRON-TYPE GOLF CLUB HEAD WITH ELEVATED WEIGHT BAR AND STRESS-RELIEVING STRUCTURES

(71) Applicant: Callaway Golf Company, Carlsbad, CA (US)

(72) Inventors: James A. Seluga, Carlsbad, CA (US); Matthew Myers, Carlsbad, CA (US); Irina Ivanova, San Diego, CA (US); Bradley C. Rice, Carlsbad, CA (US); William C. Watson, Temecula, CA (US)

(73) Assignee: Callaway Golf Company, Carlsbad, CA (US)

( * ) Notice: Subject to any disclaimer, the term of this patent is extended or adjusted under 35 U.S.C. 154(b) by 0 days.

This patent is subject to a terminal disclaimer.

(21) Appl. No.: 15/627,217

(22) Filed: Jun. 19, 2017

Related U.S. Application Data

(63) Continuation-in-part of application No. 15/447,638, filed on Mar. 2, 2017, now Pat. No. 9,687,702, which is a continuation-in-part of application No. 15/279,188, filed on Sep. 28, 2016, now Pat. No. 9,687,701, which is a continuation of application No. 14/847,227, filed on Sep. 8, 2015, now Pat. No. 9,486,677, which is a continuation-in-part of (Continued)

(51) Int. Cl.

| | |
|---|---|
| ***A63B 53/04*** | (2015.01) |
| ***A63B 53/06*** | (2015.01) |
| *A63B 60/42* | (2015.01) |

(52) U.S. Cl.
CPC ..... *A63B 53/0466* (2013.01); *A63B 53/047* (2013.01); *A63B 53/0475* (2013.01); *A63B 60/42* (2015.10); *A63B 2053/0412* (2013.01); *A63B 2053/0416* (2013.01); *A63B 2053/0433* (2013.01); *A63B 2053/0458* (2013.01); *A63B 2053/0491* (2013.01); *A63B 2209/00* (2013.01)

(58) Field of Classification Search
CPC ..... A63B 53/0466; A63B 53/047; A63B 2053/0491; A63B 2053/0412; A63B 2053/0416; A63B 60/42; A63B 2209/00; A63B 2053/0433; A63B 53/0475; A63B 2053/0458
USPC ..... 473/324–350, 287–292, 256
See application file for complete search history.

(56) References Cited

U.S. PATENT DOCUMENTS 9,486,677 B1 * 11/2016 Seluga ..... A63B 53/0466
9,687,701 B1 * 6/2017 Seluga ..... A63B 53/0466

* cited by examiner

*Primary Examiner* — Sebastiano Passaniti
(74) *Attorney, Agent, or Firm* — Rebecca Hanovice; Michael Catania; Sonia Lari

(57) ABSTRACT

A golf club head comprising a body, an elevated weight bar, and at least one stiffening member is disclosed herein. The elevated weight bar is disposed within a hollow cavity portion of the body and bridges at least a portion of a bottom section of the body, and the at least one stiffening member is also disposed within the hollow cavity portion, extending from a top line section to bottom section of the body and passing through the elevated weight bar without making contact with the elevated weight bar. The elevated weight bar, which is preferably composed of a higher density material than that of the body, may be formed separately from the rest of the body and then affixed to the body by welding or a mechanical fastener.

20 Claims, 3 Drawing Sheets

Related U.S. Application Data application No. 14/285,479, filed on May 22, 2014, now Pat. No. 9,211,451, which is a continuation-in-part of application No. 13/788,173, filed on Mar. 7, 2013, now Pat. No. 8,926,448, said application No. 14/847,227 is a continuation-in-part of application No. 14/794,578, filed on Jul. 8, 2015, and a continuation-in-part of application No. 14/788,326, filed on Jun. 30, 2015, now Pat. No. 9,597,558, said application No. 14/794,578 is a continuation-in-part of application No. 14/755,068, filed on Jun. 30, 2015, now Pat. No. 9,623,302, which is a continuation-in-part of application No. 14/498,843, filed on Sep. 26, 2014, now Pat. No. 9,259,627, which is a continuation-in-part of application No. 14/173,615, filed on Feb. 5, 2014, now Pat. No. 9,180,349, and a continuation-in-part of application No. 14/039,102, filed on Sep. 27, 2013, now Pat. No. 8,834,294, which is a continuation of application No. 13/797,404, filed on Mar. 12, 2013, now abandoned.

(60) Provisional application No. 61/898,956, filed on Nov. 1, 2013, provisional application No. 61/665,203, filed on Jun. 27, 2012, provisional application No. 61/684,079, filed on Aug. 16, 2012.

IRON-TYPE GOLF CLUB HEAD WITH ELEVATED WEIGHT BAR AND STRESS-RELIEVING STRUCTURES

CROSS REFERENCES TO RELATED APPLICATIONS

The present application is a continuation-in-part of U.S. patent application Ser. No. 15/447,638, filed on Mar. 2, 2017, and issued on Jun. 27, 2017, as U.S. Pat. No. 9,687,702, which is a continuation-in-part of U.S. patent application Ser. No. 15/279,188, filed on Sep. 28, 2016, and issued on Jun. 27, 2017, as U.S. Pat. No. 9,687,701, which is a continuation of U.S. patent application Ser. No. 14/847,227, filed on Sep. 8, 2015, and issued on Nov. 8, 2016, as U.S. Pat. No. 9,486,677, which is a continuation-in-part of U.S. patent application Ser. No. 14/285,479, filed on May 22, 2014, and issued on Dec. 15, 2015, as U.S. Pat. No. 9,211,451, which is a continuation-in-part of U.S. patent application Ser. No. 13/788,173, filed on Mar. 7, 2013, and issued on Jan. 6, 2015, as U.S. Pat. No. 8,926,448, and also is a continuation-in-part of U.S. patent application Ser. No. 14/788,326, filed on Jun. 30, 2015, and issued on Mar. 21, 2017, as U.S. Pat. No. 9,597,558, and also is a continuation-in-part of U.S. patent application Ser. No. 14/794,578, filed on Jul. 8, 2015, which is a continuation-in-part of U.S. patent application Ser. No. 14/755,068, filed on Jun. 30, 2015, and issued on Apr. 18, 2017, as U.S. Pat. No. 9,623,302, which is a continuation-in-part of U.S. patent application Ser. No. 14/498,843, filed on Sep. 26, 2014, and issued on Feb. 16, 2016, as U.S. Pat. No. 9,259,627, which is a continuation-in-part of U.S. patent application Ser. No. 14/173,615, filed on Feb. 5, 2014, and issued on Nov. 10, 2015, as U.S. Pat. No. 9,180,349, which claims priority to U.S. Provisional Patent Application No. 61/898,956, filed on Nov. 1, 2013, and which is a continuation-in-part of U.S. patent application Ser. No. 14/039,102, filed on Sep. 27, 2013, and issued on Sep. 16, 2014, as U.S. Pat. No. 8,834,294, which is a continuation of U.S. patent application Ser. No. 13/797,404, filed on Mar. 12, 2013, now abandoned, which claims priority to U.S. Provisional Patent Application Nos. 61/665,203, filed on Jun. 27, 2012, and 61/684,079, filed on Aug. 16, 2012.

STATEMENT REGARDING FEDERALLY SPONSORED RESEARCH OR DEVELOPMENT

Not Applicable

BACKGROUND OF THE INVENTION

Field of the Invention

The present invention relates to a golf club head with interior structures that increase ball speed and reduce stress in a striking face upon impact with a golf ball. More specifically, the present invention relates to an iron-type golf club head with stiffening structures intersecting an elevated weight feature without making contact with said elevated weight feature.

Description of the Related Art

The prior art discloses various golf club heads having interior structures. For example: Yabu, U.S. Pat. No. 6,852,038 for a Golf Club Head And Method of Making The Same, discloses a golf club head with a sound bar; Galloway, U.S. Pat. No. 7,118,493 for a Multiple Material Golf Club Head discloses a golf club head with a composite aft body having an interior sound component extending upward from a sole section of a metal face component; Seluga et al., U.S. Pat. No. 8,834,294 for a Golf Club Head With Center Of Gravity Adjustability discloses a golf club head with a tube having a mass for adjusting the CG of a golf club head; and Dawson et al., U.S. Pat. No. 8,900,070 for a Weighted Golf Club Head discloses a golf club head with an interior weight lip extending from the sole towards the face.

However, the prior art fails to disclose an interior structure that increases ball speed while reducing stress in the face at impact, with a minimal increase in mass to the golf club head.

BRIEF SUMMARY OF THE INVENTION

The golf club head of the present invention comprises stiffening members that connect a top line portion to a bottom portion to reduce the stress placed on a face section, and to attenuate the motion of the top line and bottom sections, during impact with a golf ball. The stiffening members preferably extend through an elevated weight bar without making contact with said weight bar, which helps the golf club head achieve a low, frontward center of gravity.

One aspect of the present invention is an iron-type golf club head comprising a body comprising a top line section, a bottom section, a face section, a heel side, a toe side, and a hollow cavity at least partially defined by the top line section, bottom section, and face section, an elevated weight bar at least partially disposed within the hollow cavity, the elevated weight bar extending from the heel side to the toe side and bridging at least a central area of the bottom section, and at least one stiffening member, wherein the face section comprises an external hitting surface, a face center, and an interior surface facing the hollow cavity, wherein the elevated weight bar comprises at least one through-bore, wherein the at least one stiffening member extends from the top line section through the at least one through-bore to the sole section, wherein no portion of the at least one stiffening member makes contact with the elevated weight bar, wherein the at least one stiffening member is located no more than 1 inch from the interior surface along a vertical plane extending through the face center, and wherein neither the elevated weight bar nor the at least one stiffening member makes contact with the interior surface of the face section.

In some embodiments, the elevated weight bar may be formed separately from the body, and may be welded or mechanically affixed to the body. In other embodiments, the top line section may comprise at least one upper aperture corresponding to the at least one stiffening member, and the bottom section may comprise at least one lower aperture corresponding to the at least one stiffening member. In yet another embodiment, the body may be composed of a first metal material having a first density, the elevated weight bar may be composed of a second metal material having a second density, the at least one stiffening member may be composed of a third metal material having a third density, and the second density may be greater than the first and second densities. In a further embodiment, the third density may be less than the first density. In any of the embodiments, the at least one stiffening member may be a solid rod, which may be composed of a metal material selected from the group consisting of steel and titanium alloy. In some embodiments, the at least one stiffening member may be located no more than 0.25 inch from the interior surface along the vertical plane. In other embodiments, the at least one stiffening member may be integrally formed with the body.

Another aspect of the present invention is an iron-type golf club head comprising a body comprising a top line section, a bottom section, a face section, a heel side, a toe side, and a hollow cavity at least partially defined by the top line section, bottom section, and face section, an elevated weight bar at least partially disposed within the hollow cavity, the elevated weight bar extending from the heel side to the toe side and bridging at least a central area of the bottom section, and first and second stiffening members, wherein the body is composed of a first metal material having a first density, wherein the elevated weight bar is composed of a second metal material having a second density, wherein the second density is greater than the first density, wherein the face section comprises an external hitting surface, a face center, and an interior surface facing the hollow cavity, wherein the elevated weight bar comprises first and second through-bores, wherein the first stiffening member is at least partially disposed within the hollow cavity and extends from the top line section through the first through-bore to the sole section, wherein the second stiffening member is at least partially disposed within the hollow cavity and extends from the top line section through the second through-bore to the sole section, wherein the first stiffening member is parallel with the second stiffening member, wherein no portion of either the first or second stiffening member makes contact with the elevated weight bar, wherein at least one of the first and second stiffening members is located no more than 0.25 inch from the interior surface along a vertical plane extending through the face center, and wherein none of the elevated weight bar, the first stiffening member, or the second stiffening member makes contact with the interior surface of the face section.

In some embodiments, the first stiffening member may be spaced a distance of 0.75 inch to 1.50 inch from the second stiffening member. In a further embodiment, each of the first and second stiffening members may be a solid metal rod, and each of the first and second stiffening members may be integrally cast with the body. In other embodiments, the first stiffening member may be disposed between the face center and the heel side, and the second stiffening member may be disposed between the face center and the toe side. In yet another embodiment, each of the first and second stiffening members may have a diameter of 0.050 inch to 0.200 inch. In a further embodiment, each of the first and second stiffening members may have a radius of curvature of 0.02 inch to 0.1 inch. In yet another embodiment, at least one of the first and second stiffening members may attenuate movement of the top line section and the bottom section when the external hitting surface impacts a golf ball. In any of the embodiments, the face section may comprise a variable thickness.

Having briefly described the present invention, the above and further objects, features and advantages thereof will be recognized by those skilled in the pertinent art from the following detailed description of the invention when taken in conjunction with the accompanying drawings.

DETAILED DESCRIPTION OF THE INVENTION

Figure 1:
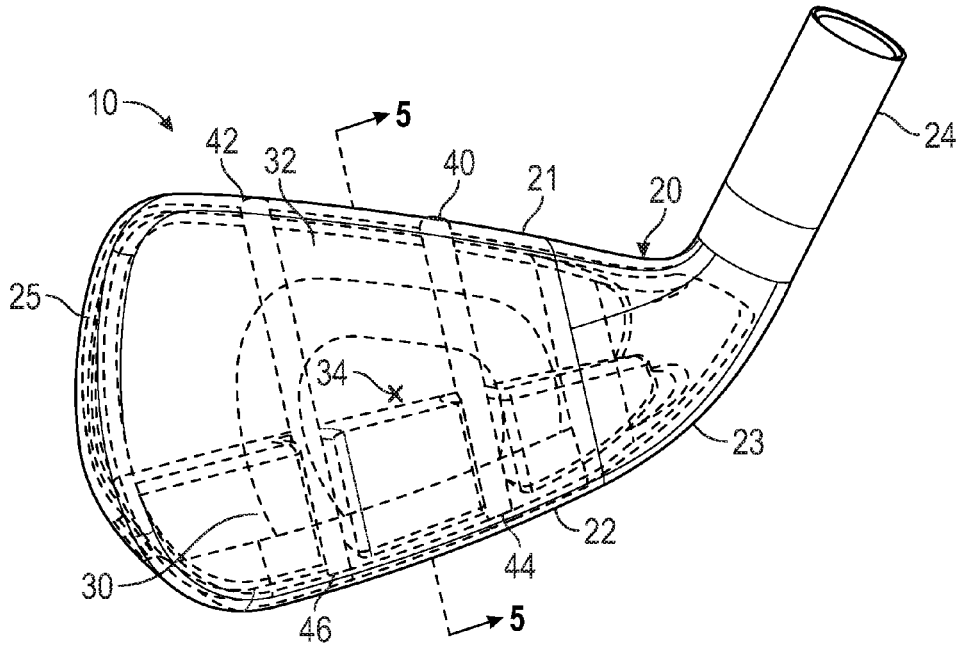
FIG. 1 is a front perspective, partially transparent view of the preferred embodiment of the golf club head.
Figure 2:
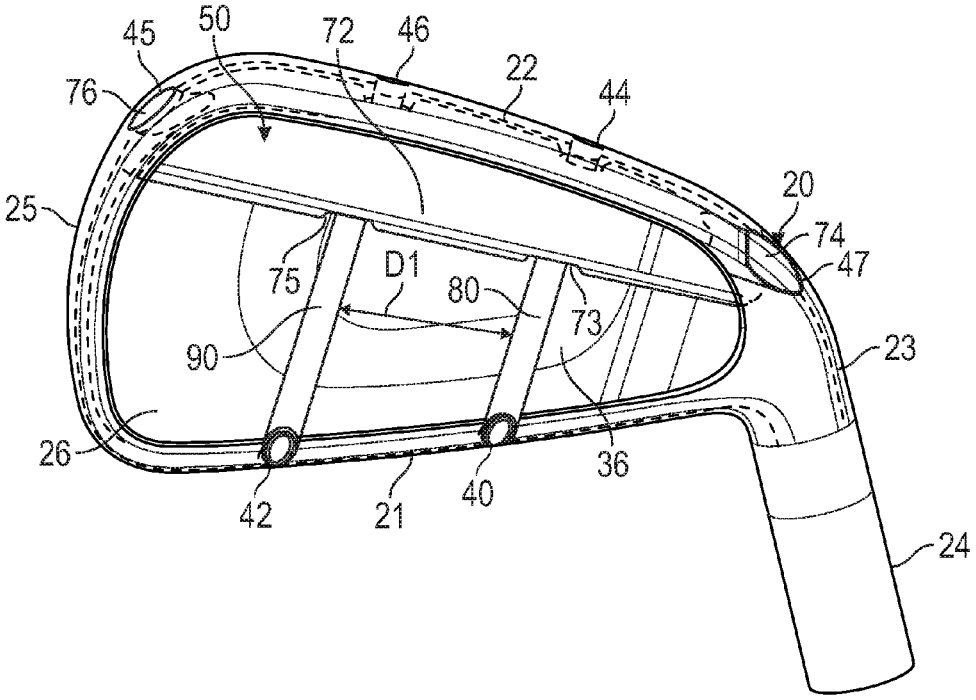
FIG. 2 is a rear perspective, partially transparent view of the golf club head shown in FIG. 1.
Figure 3:
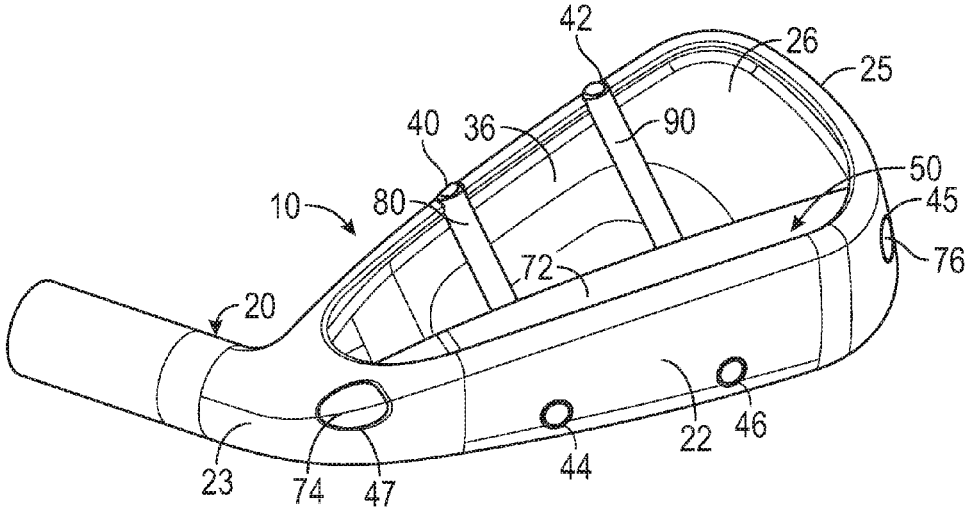
FIG. 3 is a bottom perspective view of the golf club head shown in FIG. 1.
Figure 4:
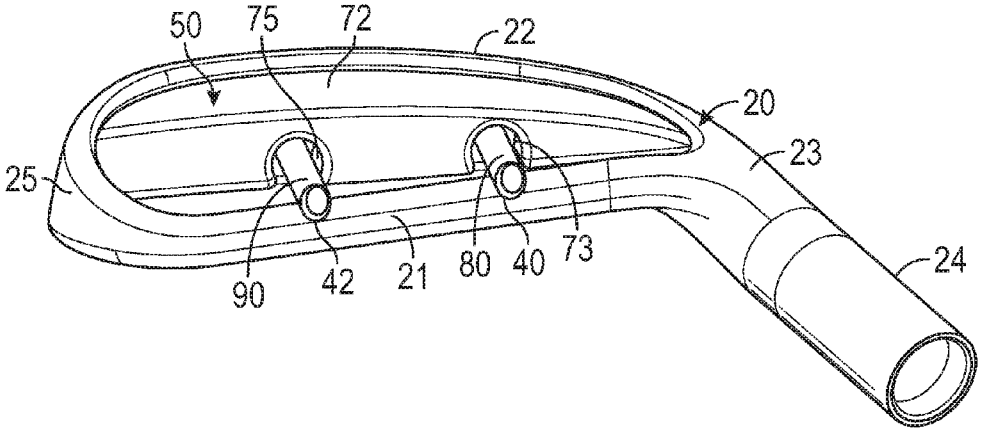
FIG. 4 is a top perspective view of the golf club head shown in FIG. 1.
Figure 5:
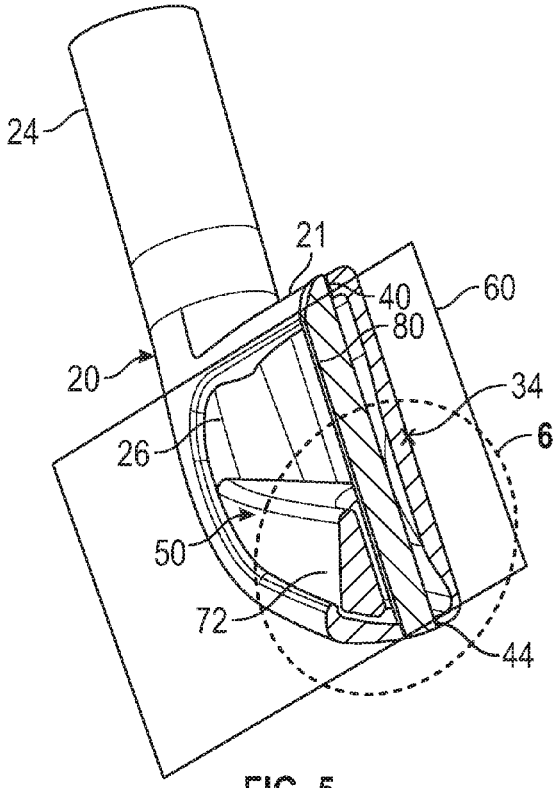
FIG. 5 is a cross-sectional view of the golf club head shown in FIG. 1 along lines 5-5.
Figure 6:
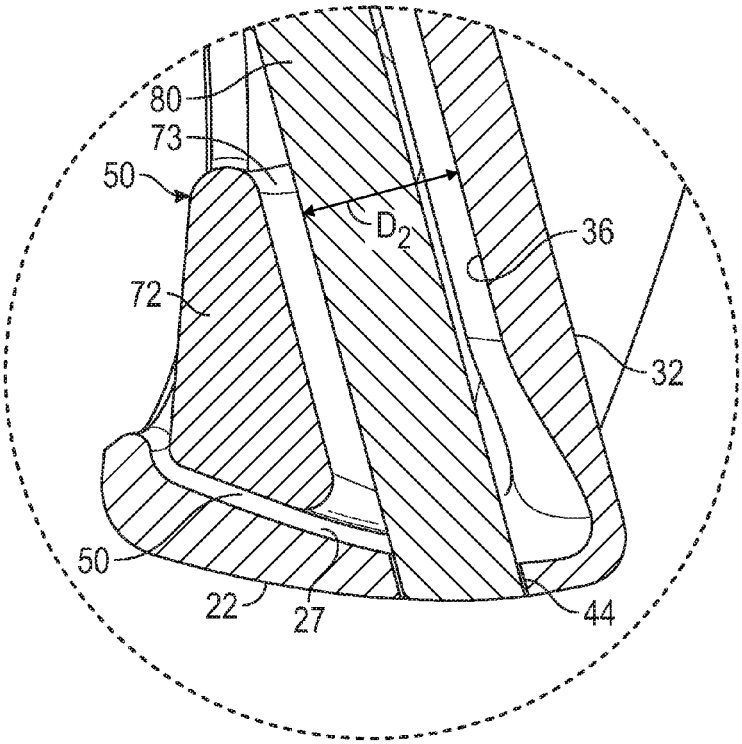
FIG. 6 is an enlarged view of the circled portion of the golf club head shown in FIG. 5.

A preferred embodiment of the iron-type golf club head 10 of the present invention is shown in FIGS. 1-6. The golf club head 10 comprises a body 20 having a top line section 21, a bottom section 22, a heel side 23 where a hosel 24 connects with the body 20, a toe side 25, a face section 30, and a hollow interior cavity 26 defined by the top line section 21, bottom section 22, and face section 30. The face section 30 includes an external hitting surface 32, a face center 34, and an interior surface 36 facing the hollow cavity 26, and preferably comprises a variable thickness pattern. The top line section 21 comprises first and second upper apertures 40, 42 that are vertically aligned with first and second lower apertures 44, 46 disposed in the bottom section 22; these apertures 40, 42, 44, 46 may be supported by bosses (not shown). The toe side 25 comprises a toe side aperture 45 and the heel side 23 comprises a heel side aperture 47, each of which communicates with the hollow interior cavity 26.

The golf club head 10 also comprises an elevated weight bar 70 that is manufactured separately from the body 20 from a material having a higher density than the material from which the body 20 is manufactured. For example, the elevated weight bar 70 may be composed of a tungsten alloy, while the body 20 may be composed of steel or titanium alloy. The elevated weight bar 70, which is disposed within the hollow cavity 26 proximate the interior surface 36 of the face section 30, comprises a central section 72, a heel protrusion 74 that engages the heel side aperture 47, and a toe protrusion 76 that engages the toe side aperture 45. When the heel and toe protrusions 74, 76 are engaged with the heel and toe side apertures 47, 45 respectively, the central section 72 bridges at least a central area of the bottom section 22 so that there is a gap 50 between the central section 72 and an inner surface 27 of the bottom section 22. The heel and toe protrusions 74, 76 may be welded to the body 20 or otherwise mechanically affixed to the body 20 so that the elevated weight bar 70 is secured in place within the hollow cavity 26. The elevated weight bar 70 also includes a first through-bore 73 that is vertically aligned with the first upper and lower apertures 40, 44 and a second through-bore 75 that is vertically aligned with the second upper and lower apertures 42, 46.

As shown in the Figures, the golf club head 10 includes a pair of stiffening members 80, 90 disposed within the hollow cavity 26 proximate, but spaced from, the interior surface 36 of the face section 30. Each stiffening member 80, 90 preferably is a solid rod composed of a lightweight, strong metal material such as titanium alloy or steel, and is either mechanically affixed to, co-cast with, or otherwise integrally formed with, the body 20. If the stiffening members 80, 90 are co-cast with the body 20, the combination may be accomplished using the method disclosed in U.S. Provisional Patent Application No. 62/442,892, the disclosure of which is hereby incorporated by reference in its entirety herein. If the stiffening members 80, 90 are formed separately from the body 20, they may be composed of a different material; for example, the stiffening members 80, 90 may be composed of a steel having a lower density than the steel used to make the body 20.

In the preferred embodiment, the first stiffening member 80 is disposed between the face center 34 and the heel side 23 and extends from the first upper aperture 40 through the first through-bore 73 and into the first lower aperture 44. The second stiffening member 90 is disposed between the face center 34 and the toe side 25 and extends from the second upper aperture 42 through the second through-bore 75 and into the second lower aperture 46. The first stiffening member 80 is parallel with the second stiffening member 90 and spaced a distance $D_1$ of 0.75 inch to 1.50 inch from the second stiffening member 90. No portion of either stiffening member 80, 90 makes contact with any portion of the elevated weight bar 70, and none of the elevated weight bar 70, first stiffening member 80, or second stiffening member 90 makes contact with the interior surface 36 of the face section 30.

Each stiffening member 80, 90 is preferably located within a distance $D_2$ of 1 inch of the interior surface 36 of the face section 30 measured along a vertical plane 60 extending through the face center 34 perpendicular to the face section 30. No portion of either of the stiffening members 80, 90 should be located outside of this 1-inch distance $D_2$; in fact, it is more preferable for each stiffening member 80, 90 to be located within 0.25 inch of the interior surface 36 to improve ball speed and reduce the stress placed on the face section 30 during impact with a golf ball. Each stiffening member 80, 90 preferably has a diameter of 0.050 inch to 0.200 inch and a length of 1 to 2.5 inches, and a radius of curvature ranging from 0.02 inch to 0.1 inch, more preferably 0.025 inch to 0.05 inch, and most preferably 0.0395 inch.

In an alternative embodiment, the elevated weight bar 70 may be integrally cast with the body 20. The elevated weight bar 70 may also include features and/or material compositions disclosed in U.S. Pat. Nos. 8,926,448, 8,900,070, 9,211,451, and 9,586,105, and in U.S. patent application Ser. No. 15/285,712, the disclosure of each of which is hereby incorporated by reference in its entirety herein. In any of the embodiments disclosed herein, the stiffening members 80, 90 may be placed in tension or in compression between the top line section 21 and the bottom section 22.

From the foregoing it is believed that those skilled in the pertinent art will recognize the meritorious advancement of this invention and will readily understand that while the present invention has been described in association with a preferred embodiment thereof, and other embodiments illustrated in the accompanying drawings, numerous changes, modifications and substitutions of equivalents may be made therein without departing from the spirit and scope of this invention which is intended to be unlimited by the foregoing except as may appear in the following appended claims. Therefore, the embodiments of the invention in which an exclusive property or privilege is claimed are defined in the following appended claims.

We claim as our invention the following:

1. An iron-type golf club head comprising:

a body comprising a top line section, a bottom section, a face section, a heel side, a toe side, and a hollow cavity at least partially defined by the top line section, the bottom section, and the face section;

an elevated weight bar at least partially disposed within the hollow cavity, the elevated weight bar extending from the heel side to the toe side and bridging at least a central area of the bottom section; and at least one stiffening member, wherein the face section comprises an external hitting surface, a face center, and an interior surface facing the hollow cavity, wherein the elevated weight bar comprises at least one through-bore, wherein the at least one stiffening member extends from the top line section through the at least one through-bore to the sole section, wherein no portion of the at least one stiffening member makes contact with the elevated weight bar, wherein the at least one stiffening member is located no more than 1 inch from the interior surface along a vertical plane extending through the face center, and wherein neither the elevated weight bar nor the at least one stiffening member makes contact with the interior surface of the face section.

2. The iron-type golf club head of claim 1, wherein the elevated weight bar is formed separately from the body.

3. The iron-type golf club head of claim 2, wherein the elevated weight bar is welded to the body.

4. The iron-type golf club head of claim 2, wherein the elevated weight bar is mechanically affixed to the body.

5. The iron-type golf club head of claim 1, wherein the top line section comprises at least one upper aperture corresponding to the at least one stiffening member, and wherein the bottom section comprises at least one lower aperture corresponding to the at least one stiffening member.

6. The iron-type golf club head of claim 1, wherein the body is composed of a first metal material having a first density, wherein the elevated weight bar is composed of a second metal material having a second density, wherein the at least one stiffening member is composed of a third metal material having a third density, and wherein the second density is greater than the first and second densities.

7. The iron-type golf club head of claim 6, wherein the third density is less than the first density.

8. The iron-type golf club head of claim 1, wherein the at least one stiffening member is a solid rod.

9. The iron-type golf club head of claim 8, wherein the at least one stiffening member is composed of a metal material selected from the group consisting of steel and titanium alloy.

10. The iron-type golf club head of claim 1, wherein the at least one stiffening member is located no more than 0.25 inch from the interior surface along the vertical plane.

11. The iron-type golf club head of claim 1, wherein the at least one stiffening member is integrally formed with the body.

12. An iron-type golf club head comprising:

a body comprising a top line section, a bottom section, a face section, a heel side, a toe side, and a hollow cavity at least partially defined by the top line section, the bottom section, and the face section;

an elevated weight bar at least partially disposed within the hollow cavity, the elevated weight bar extending from the heel side to the toe side and bridging at least a central area of the bottom section; and first and second stiffening members, wherein the body is composed of a first metal material having a first density, wherein the elevated weight bar is composed of a second metal material having a second density, wherein the second density is greater than the first density, wherein the face section comprises an external hitting surface, a face center, and an interior surface facing the hollow cavity, wherein the elevated weight bar comprises first and second through-bores, wherein the first stiffening member is at least partially disposed within the hollow cavity and extends from the top line section through the first through-bore to the sole section, wherein the second stiffening member is at least partially disposed within the hollow cavity and extends from the top line section through the second through-bore to the sole section, wherein the first stiffening member is parallel with the second stiffening member, wherein no portion of either the first or second stiffening member makes contact with the elevated weight bar, wherein at least one of the first and second stiffening members is located no more than 0.25 inch from the interior surface along a vertical plane extending through the face center, and wherein none of the elevated weight bar, the first stiffening member, or the second stiffening member makes contact with the interior surface of the face section.

13. The iron-type golf club head of claim 12, wherein the first stiffening member is spaced a distance of 0.75 inch to 1.50 inch from the second stiffening member.

14. The iron-type golf club head of claim 13, wherein each of the first and second stiffening members is a solid metal rod.

15. The iron-type golf club head of claim 14, wherein each of the first and second stiffening members is integrally cast with the body.

16. The iron-type golf club head of claim 12, wherein the first stiffening member is disposed between the face center and the heel side, and wherein the second stiffening member is disposed between the face center and the toe side.

17. The iron-type golf club head of claim 12, wherein each of the first and second stiffening members has a diameter of 0.050 inch to 0.200 inch.

18. The iron-type golf club head of claim 17, wherein each of the first and second stiffening members has a radius of curvature of 0.02 inch to 0.1 inch.

19. The iron-type golf club head of claim 12, wherein at least one of the first and second stiffening members attenuates movement of the top line section and the bottom section when the external hitting surface impacts a golf ball.

20. The iron-type golf club head of claim 12, wherein the face section comprises a variable thickness.

* * * * *